US005815945A

United States Patent [19]

Ando

[11] Patent Number: 5,815,945

[45] Date of Patent: Oct. 6, 1998

[54] PIT MEMBRANE-BROKEN WOOD DRYING METHOD AND APPARATUS

[75] Inventor: Minoru Ando, Utsunomiya, Japan

[73] Assignees: Chuou Mokuzai Kaihatsu Kabusiki Kaisha, Tokorozawa; Minoru Ando, Utsunomiya, both of Japan

[21] Appl. No.: 652,549

[22] PCT Filed: Oct. 12, 1995

[86] PCT No.: PCT/JP95/02083

§ 371 Date: Oct. 2, 1996

§ 102(e) Date: Oct. 2, 1996

[87] PCT Pub. No.: WO96/11780

PCT Pub. Date: Apr. 25, 1996

[30] Foreign Application Priority Data

Oct. 12, 1994 [JP] Japan ..... 6-272954
Oct. 12, 1994 [JP] Japan ..... 6-272955

[51] Int. Cl.[6] ..... F26B 3/34

[52] U.S. Cl. ..... 34/269; 34/396; 34/417; 34/443; 34/479; 34/539; 34/212; 34/225

[58] Field of Search ..... 34/267, 269, 396, 34/417, 443, 478, 479, 497, 518, 539, 196, 212, 219, 225; 427/297, 298, 440, 441; 428/541; 432/92

[56] References Cited

U.S. PATENT DOCUMENTS

| | | | |
|---|---|---|---|
| 1,413,018 | 4/1922 | Fujino | 34/396 X |
| 4,179,820 | 12/1979 | Steffensen et al. | 34/242 X |
| 5,293,700 | 3/1994 | Ishii | 34/225 |
| 5,472,720 | 12/1995 | Rakhimov et al. | 426/241 |

OTHER PUBLICATIONS

Membrane Structure of Bordered Pit on the Tangential Wall of Tracheid in Coniferae Species, Seizo Fujikawa et al. Mokuzai Gakkaishi vol. 20 No. 3 pp. 103–110 1974.

IAWA Bulletin vol. 8(3) pp. 237–244, 1987.

Notes on Torus Development in the Wood of Osmanthus Americanus, Roland R. Dute et al. IAWA Bulletin vol. 9(1) pp. 41–51, 1988.

*Primary Examiner*—Harold Joyce
*Assistant Examiner*—Steve Gravini
*Attorney, Agent, or Firm*—Oblon, Spivak, McClelland, Maier & Neustadt, P.C.

[57] ABSTRACT

The present invention is intended to artificially break pit membranes in cell membranes of cells constituting wood and then to readily attain dryness of the wood. In view of the fact that one pit or the other pit of pits in the form of a pair is blocked with the torus 1 in felled wood to cause poor removal of water in cells, it is intended to prevent the blockage of the pit membrane, i.e., to break the pit membrane per se, thereby facilitating easy escapement of water in cells after the breaking. In the present invention, wood fuel is burned, and subject wood is allowed to stand in a treatment chamber filled with smoky wood gas generated by the combustion for a predetermined period of time, to expose the subject wood to far-infrared radiation and components contained in the wood gas. Further, ceramic material for multiplying far-infrared radiation or high-density lava is heaped in a combustion chamber with appropriate gaps left therebetween, thereby effecting heat reservation and further multiplication of far-infrared radiation. Accordingly, the subject wood is irradiated with a large amount of far-infrared radiation, thereby preventing the torus of the wood from blocking up one pit or the other pit of pits in the form of a pair to form gaps in the pits.

19 Claims, 9 Drawing Sheets

PIT MEMBRANE-BROKEN WOOD DRYING METHOD AND APPARATUS

TECHNICAL FIELD

The present invention relates to wood having its pit membranes between cells constituting the wood broken for enabling wood drying to be effectively carried out.

BACKGROUND ART

The present inventor has already proposed a technique intended to greatly reduce a cost in wood drying by removing growth stress in wood (Japanese Patent Application No.308723/1993).

Wood from a naturally grown tree is, in itself, indispensable to human life from ancient times as a material for houses or furniture. To utilize wood as a material for houses or furniture, however, wood must be sufficiently dried and then subjected to work.

This is because wood immediately after felling contains large amount of water, wood undergoes contraction or expansion with time depending upon amount of water content, thereby leading to imbalances in shape or dimension. Further, physical and chemical properties of wood varies depending upon change in water content. Accordingly, to reduce water content, wood has heretofore been dried sufficiently over a long period of time to such an extent that the wood would undergo .no substantial deformation, and then subjected to work.

Wood drying includes natural drying carried out over a period of several tens years and artificial drying effected by forcing water contained in wood as described above to evaporate under a hot air stream. In particular, artificial drying is expensive and thus employs various techniques under-the existing circumstances.

However, such wood drying heretofore carried out is intended to remove water contained cells constituting wood naturally over a long period of time or forcibly by adding various steps such as heating, when considered at level of cells constituting wood.

However, wood is vital before felling, and thus, it is said that even if some branches and the like are damaged, self-remedy activity spontaneously functions for closing pits present between cells constituting wood, in particular, cells constituting tracheids and vessels which lead to the damaged branches to prevent contained water from escaping.

In other words, nutrients and water are essential for growth of tree, and wood absorbs nutrients and water from its roots and transfer the nutrients and water to its trunk, branches and leaves through pipes composed of cells referred to as tracheids or vessels. Individual cells constituting wood deliver or receive the nutrient and water between the cells by themselves or through the tracheids or vessels. Accordingly, a large number of small apertures or depressions referred to as pits (formerly explained as Mon-Koh) are present in cell membranes between the cells.

The pits are present generally in the form of a pair between two cells as described below, and therefore, often referred to as pit-pair. The basic structure is as schematically shown in FIG. 1. FIG. 1(*a*) is a schematic view showing basic structure of a section of a pit membrane, and FIG. 1(*b*) is a schematic plan view of the pit membrane, wherein character 1 represents torus, 2 a margo, and $\mathbf{3}_1$ and $\mathbf{3}_2$ pits. Cells of a tree having pits of such a basic structure are so constructed that, for growth of the tree, a gap is provided between the torus 1 and one pit $\mathbf{3}_1$ or the other pit $\mathbf{3}_2$ of the pit-pair to intercellularly supply nutrients and water essential for growth of the tree.

In other words, between such a pit-pair a membrane referred to as pit membrane is present, and the membrane comprises a torus (T) and a margo (M). These constitute such a mechanism that if some of cells constituting wood are once broken by, for example, felling of tree, pits in cell membranes are closed by self-remedy activity of the cells per se constituting the wood to prevent water contained in the cells from escaping.

To prevent evaporation of the water contained in the cell constituting the wood, the one pit 3 1 or the other pit $\mathbf{3}_2$ of the pit-pair is blocked with the torus 1 (see FIGS. 1(*c*) and 1(*d*)) to prevent moisture gradient. Electron micrographs of pits between cells are shown in FIGS.2(1) and (2).

Accordingly, if wood is intended to be dried sufficiently, there is no choice but to wait water contained therein (including water which passes through pit membranes) to escape. This is the reason for the long period of time required to dry wood or the forced drying in a short period by forcibly removing water in cells by means of intense heat treatment or the like.

Therefore, to attain sufficient dryness of wood, wood has been placed under eaves over a long period of time (up to a period of several tens years) to wait the wood to naturally dry, or wood has been subjected to a predetermined heating in a heating furnace or immersed in hot water for a predetermined period to accelerate drying. For natural drying, however, wood must be allowed to stand for a long period of time. In particular, it is disadvantageous in terms of high cost to let expensive wood of precious wood lie idle.

On the other hand, in artificial drying, dried condition is not so good as that in natural drying. Further, there is undesired possibility that wood is partially heated. This tends to cause distortion or deformation. In addition to the drawback that artificial drying cannot be used for valuable wood which should not undergo distortion or warpage, artificial drying requires expensive equipments and is thus unsatisfactory in increased cost with respect to inexpensive materials and the like.

The present invention overthrows the concept of the wood drying heretofore practiced and is intended to artificially break pit membranes in cell membranes of cells constituting wood and then to readily attain dryness of the wood. In view of the fact that one pit $\mathbf{3}_1$ or the other pit $\mathbf{3}_2$ of pits in the form of a pair is blocked with the torus 1 in felled wood to cause poor removal of water in cells, it is intended to prevent the blockage of the pit membrane, i.e., to break the pit membrane per se, thereby facilitating easy escapement of water in cells after the breaking.

To attain this, subject wood is impregnated with far-infrared radiation to raise a temperature in the wood by the irradiation and to thereby break the pit membrane, or wood is deeply impregnated with wood gas by filling a treatment chamber with the wood gas generated by combustion of wood fuel to thereby cause tar to adhere to the pit membrane, thus breaking the pit membrane.

DISCLOSURE OF THE INVENTION

Specifically, wood field 32 which is capable of providing high thermal efficiency wood gas containing about 30% of far-infrared radiation is burned, a grate 4 is placed above flames and porous ceramic material or lava 5 substantially equivalent thereto is placed thereon to heat the ceramic material or lava to glow red, thereby generating a plenty of far-infrared radiation.

Then, the hot gas stream enters a neighboring chamber 22 for multiplying the far-infrared radiation to promote breakage of pit membranes though an air duct 6, and passes through gaps appropriately formed in a heap of ceramic blocks for multiplying far-infrared radiation or high-density lava 23 or the like in the chamber 22, thereby effecting heat reservation and further multiplication of far-infrared radiation. The hot gas passes through platinum or stainless steel wire meshes 21 disposed in air holes 20 provided in a hole 8 of a treatment chamber 27 to fill the treatment chamber 27 therewith, thereby exposing subject wood to the wood gas containing a large amount of far-infrared radiation to raise a temperature in the wood while irradiating the wood with the far-infrared radiation.

By the treatment, in felled wood, one pit $\mathbf{3}_1$ or the other pit $\mathbf{3}_2$ of the pits in the form of a pair is broken to prevent the torus 1 from blocking up the pit membrane.

In other words, as a result of the treatment, margos 2 in pit membranes between cells constituting wood are thoroughly broken or pits are deformed or cracked to partially break blockage of the pits with tori, thus forming gaps therebetween, as shown in electron micrographs.

Further, wood fuel is burned as a fuel, and subject wood is allowed to stand in a treatment chamber filled with wood gas generated by the combustion for a predetermined period of time. The wood gas prevents the torus 1 in felled wood from blocking up one pit $\mathbf{3}_1$ or the other pit $\mathbf{3}_2$ of the pits in the form of a pair, thereby forming gaps in the pits.

BRIEF DESCRIPTION OF THE DRAWINGS

FIG. 1(*a*) schematically shows the structure in section, FIG. 1(*b*) the structure in plan, and FIGS. 1(*c*) and (*d*) respectively, one pit $\mathbf{3}_1$ and the other pit $\mathbf{3}_2$ of pits in the form of a pair blocked with torus to prevent intercellular movement of water contained in cells.

BEST MODE FOR CARRYING OUT THE INVENTION

Figure 1A:
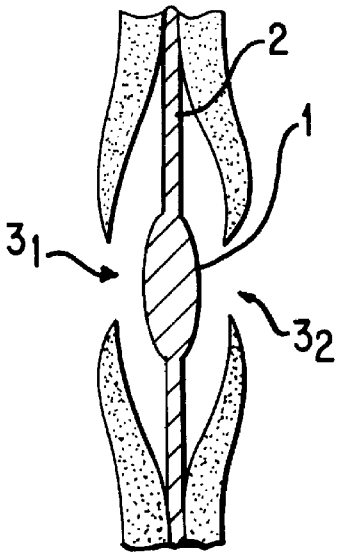
FIGS. 1 (*a*)–(*d*) are schematic illustrations showing a basic structure of a pit membrane.
Figure 1B:
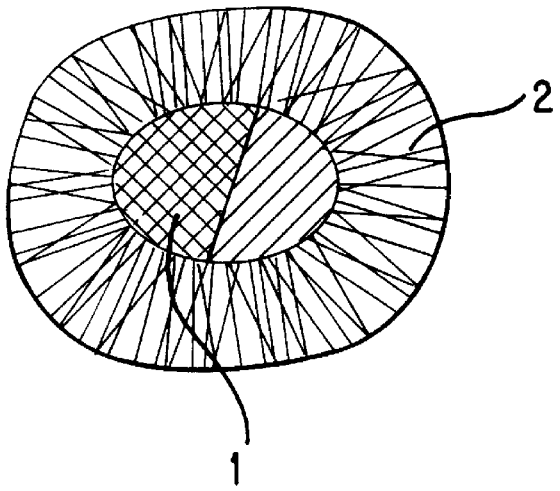
Figure 1C:
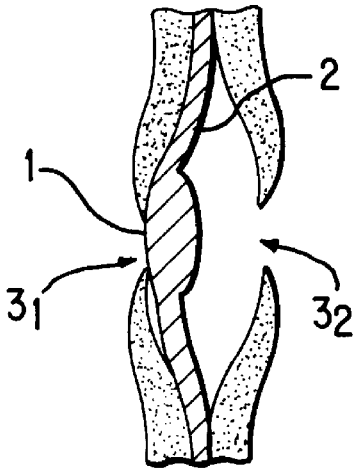
Figure 1D:
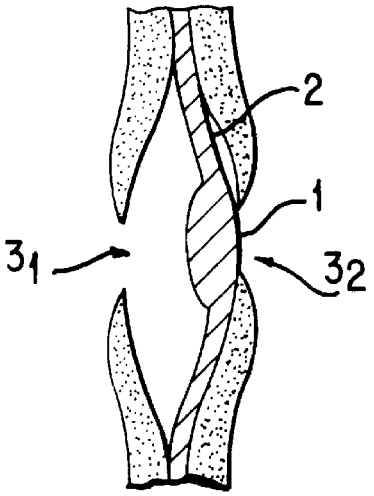
Figure 2A:
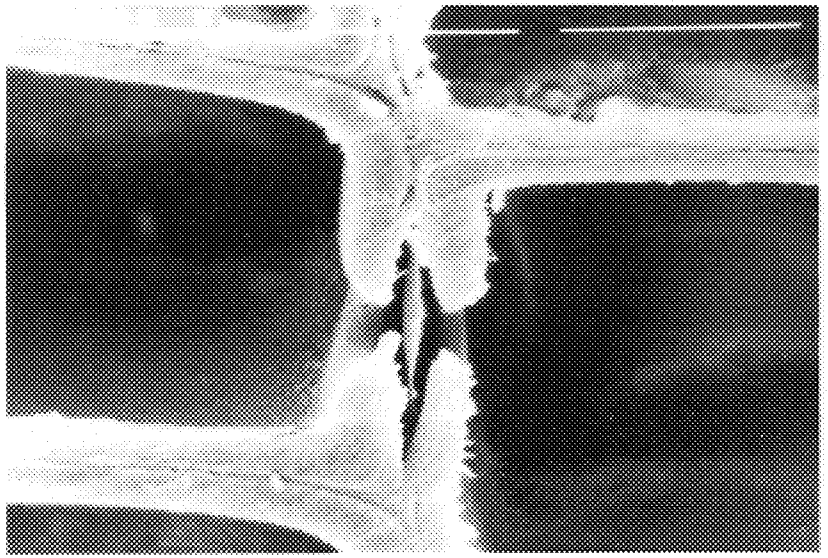
FIGS. 2(*a*) and (*b*) are electron micrographs of untreated pits between cells.
Figure 2B:
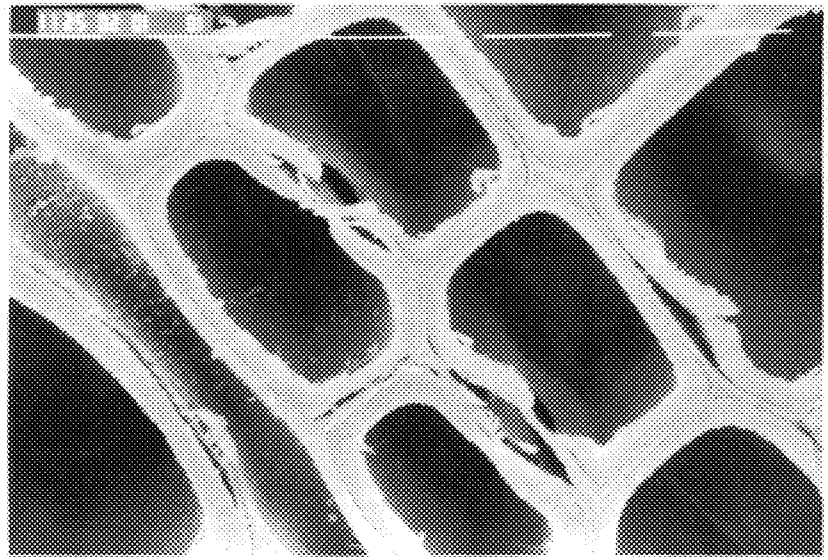

In the present invention, pits and pit membranes in cell membranes of cells constituting wood are artificially broken to easily attain dryness of wood. Accordingly, the torus 1 in felled wood is prevented from blocking up one pit $\mathbf{3}_1$ or the other pit $\mathbf{3}_2$ of the pits in the form of a pair, that is, the margo 2 in the pit membrane between cells constituting wood is thoroughly broken or the pits; are deformed or cracked to partially break blockage of the pits with tori, thus forming gaps therebetween to facilitate escapement of water in the cells through the gaps.

In other words, even if moisture gradient is caused between cells constituting wood due to partial dryness caused by felling, a torus in a pit membrane which serves as a valve in intercellular delivery and receipt of nutrients and water is forced to adhere to a pit or the pit membrane per se is broken, thereby terminating moisture gradient preventive function.

Specifically, in the present invention, temperature in subject wood is rapidly raised while exposing the wood to wood gas containing a plenty of far-infrared radiation to prevent the torus 1 of margo 2 form blocking up one pit $\mathbf{3}_1$ or the other pit $\mathbf{3}_2$ of the pits in the form of a pair or to break the pit(s) per se. In other words, the temperature in the wood is raised by the exposure to the wood gas containing far-infrared radiation, and in consequence thereof, thermal expansion of air and water in cells constituting the wood is or, probably, generation of vapor pressure is caused, thereby partially or completely breaking the pit membrane. Then, tar in the wood gas is caused to adhere to the broken pit membrane.

It is not clearly understood why pit membranes are broken by allowing subject wood to stand in wood gas generated by combustion of wood fuel for a predetermined period of time in the present invention, but is believed to be probably attributable to phenomenon that tar of the generated wood gas or gas resulting from combustion of the wood gas, or resinous components contained in wood impregnates deeply into the wood to adhere to various portions of the pits to prevent complete blockage of the pit membrane (the adhered tar has a knot or grain shape).

EXAMPLE

An embodiment of the treatment furnace according to of the present invention for preparing pit membrane-broken wood by breaking pits between cells constituting the wood will be described with reference to the drawing.

Figure 3:
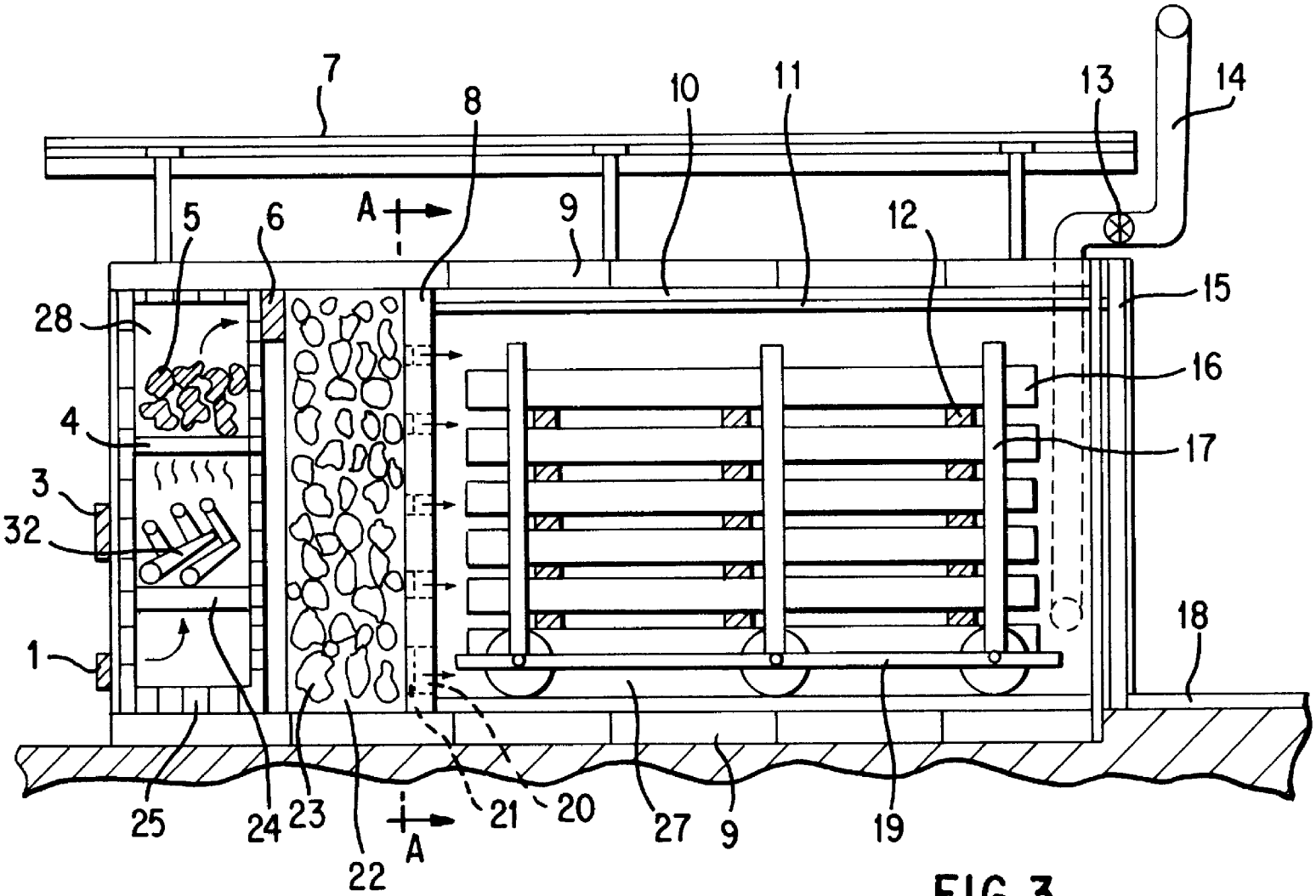
FIG. 3 is a schematic view showing one form of the treatment chamber according to the present invention for preparing pit membrane-broken wood by breaking pits between cells constituting the wood.

FIG. 3 is a sectional side view of the pit membrane breaking furnace according to the present invention for pit membrane breaking treatment by means of wood gas including far-infrared radiation.

In FIG. 3, character 1 represents an air intake, 2 wood fuel, 3 a fuel inlet, 4 a grate, 5 a far-infrared multiplying ceramic block made of a high-density lava or the like material, which multiply far-infrared radiation to promote pit membrane-breaking treatment by means of wood gas. Character 6 represents an air duct for introducing wood, gas containing far-infrared radiation, 7 a roof for protecting the entirety from weather, 8 a wall of a treatment chamber 27 at combustion chamber side, 9 a furnace wall-constituent box culvert made of a concrete, 10 a glass wool heat insulator for preventing heat in the treatment chamber 27 from escaping therefrom, 11 a ceramic board for efficiently convert heat in the treatment chamber 27 to far-infrared radiation, 12 a crosspiece inserted between logs 16 to be treated to facilitate heat transfer around the logs, 13 a ventilating fan for controlling a temperature in the treatment chamber 27, 14 an air duct for discharging wood gas containing far-infrared radiation out of the treatment chamber 27 by rotation of the ventilating fan 13, 15 a rear door for carrying-in logs 1 . 16 to be treated and carrying-out logs treated, and 16 a log under treatment. Character 17 represents a supporting prop attached to a truck deck to prevent fall of a stack of logs, 18 rails for the truck, 19 a truck deck, 20 an air hole formed in the wall of the treatment furnace: 27 at the combustion chamber side for leading wood gas containing far-infrared radiation, 21, a platinum or stainless steel wire mesh for preventing sparks caused by combustion from entering the treatment chamber 27, and 22 a chamber for multiplying far-infrared radiation to promote breaking of pit membrane, which is filled with a high-density lava or far-infrared-multiplying ceramic material 23 to effectively expose the logs 16 under treatment to wood gas sufficiently containing far-infrared radiation.

Character 24 represents a combustion grate, 25 a fire brick, 27 a treatment furnace, and 28 a combustion chamber.

In this embodiment, the ceramic blocks and the platinum wire mesh or the like are interposed between flames of the wood fuel and the logs under treatment to filter off sparks from the wood fu(l., thereby preventing inflammation of the logs.

For this purpose, the air holes formed in the wall 8 of the treatment chamber 27 are such that an air hole at a lower position has a larger opening so as to make temperature in the treatment furnace uniform throughout upper and lower parts. It is, however, to be noted that this is not intended to be restrictive with respect to shape, size, number and the like of the air holes.

In the next place, the procedure of the log treatment using this furnace will be described. The rear door 15 of the treatment chamber 27 is opened to introduce logs 16 stacked on the truck 19 therethrough and then the door is closed. With the ventilating fan 13 rotated, wood fuel is ignited to repletively produce wood gas and the ceramic blocks 5 or the like on the grate 4 are heated to glow red. In this connection, as the logs to be treated, SUGI logs of 16 cm in tip diameter are used.

The wood gas containing a plenty of far-infrared radiation is introduced via the air duct 6 into the next chamber to multiply far-infrared, and flows through narrow gaps between the high-density lava or far-infrared multiplying ceramic material 23 placed in the chamber 22 for promoting pit-membrane breaking and through the air holes 20 of the treatment chamber 27, thus permeating in the treatment chamber. The temperature in the treatment chamber is controlled within a desired range by adjusting wood fuel supply and opening-closing of the air inlet I to regulate wood gas supply while watching a temperature sensor inserted in the log treating furnace. With respect to the temperature control, the use of such a structure that heat reserving of the treatment chamber is effected by means of the far-infrared multiplying ceramics or high-density lava 23 enables uneven heating by combustion of the wood fuel to be reduced and also enables temperature decrease in the treatment chamber to be prevented without supplying fuel during night time.

Figure 4A:
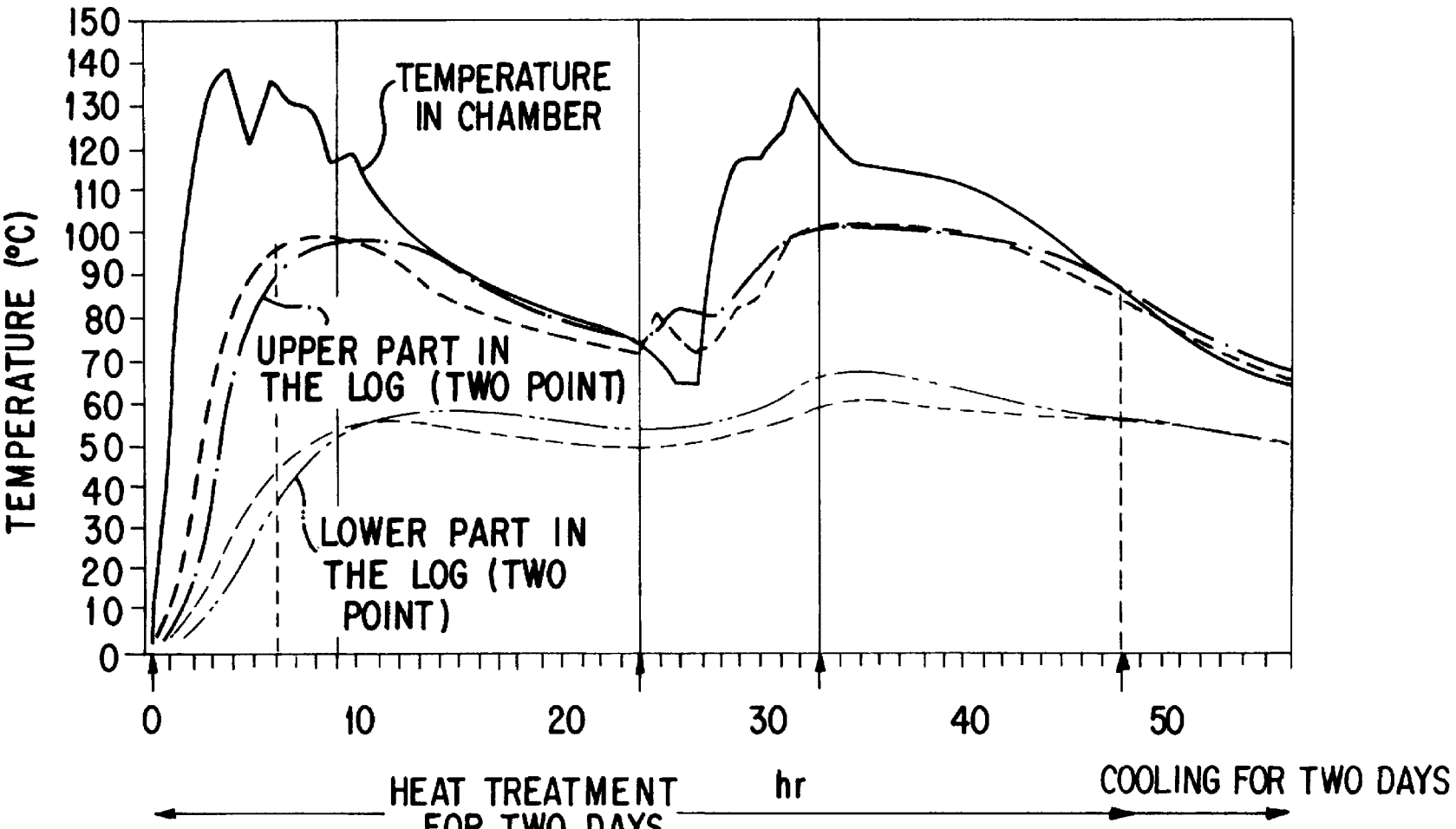
FIG. 4 (*a*) is a graphical representation showing progress of conditions of temperatures in the treatment furnace and in subject logs during the treatment, and FIG. 4 (*b*) is an illustration showing positions of the subject logs in the furnace.
Figure 4B:
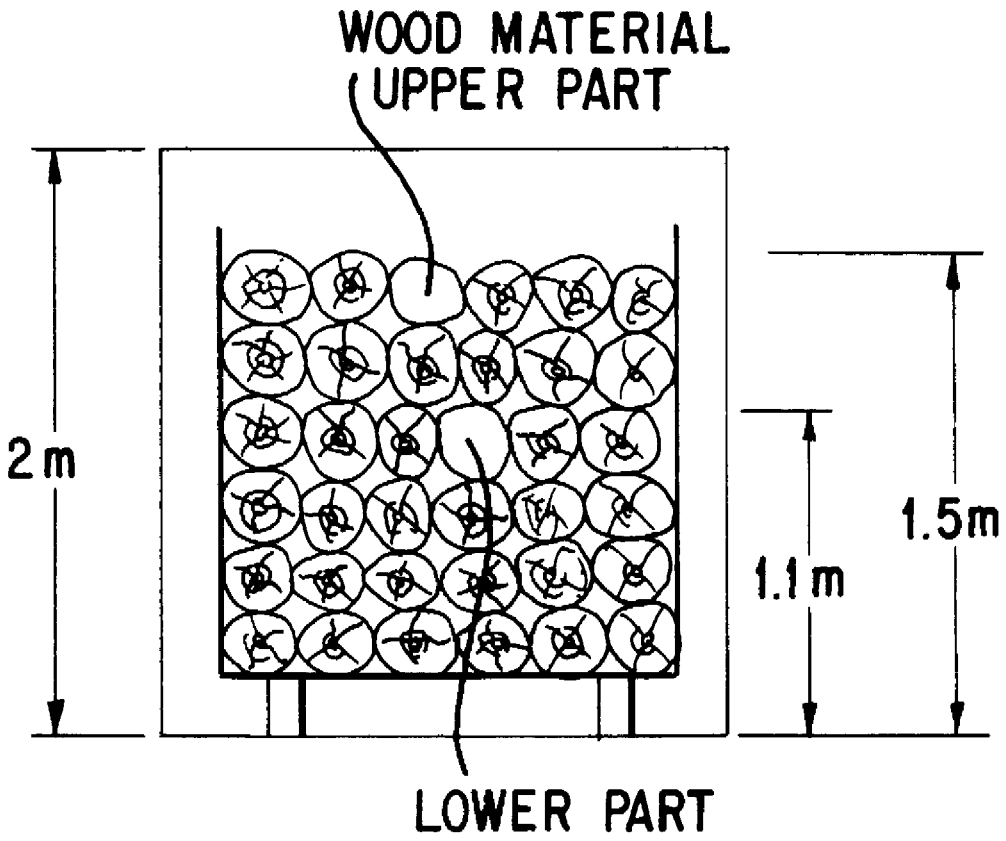
Figure 5A:
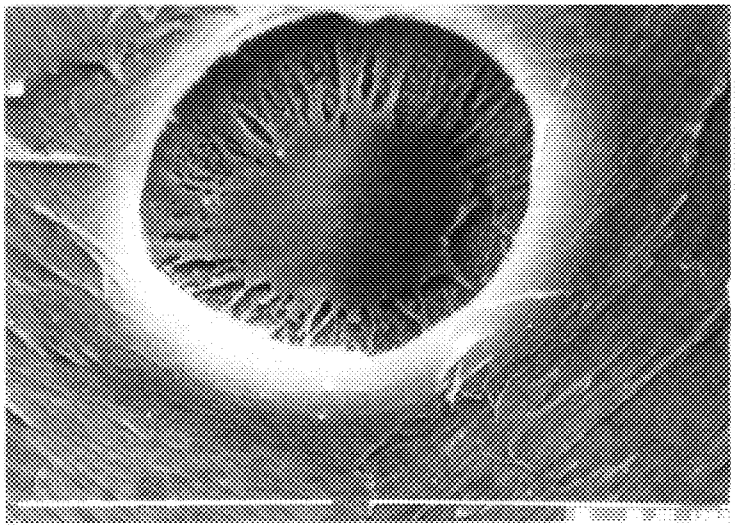
FIGS. 5(A)–(D) are electron micrographs showing tissue structure of untreated wood, in which pits present along walls constituting tracheids are frontally viewed. I
Figure 5B:
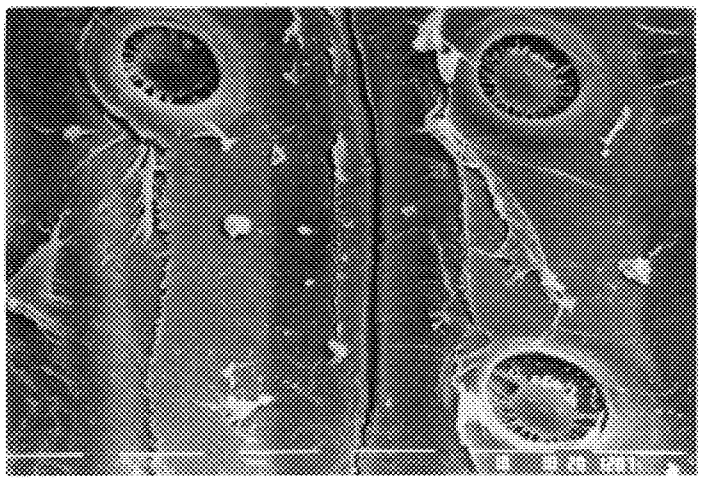
Figure 5C:
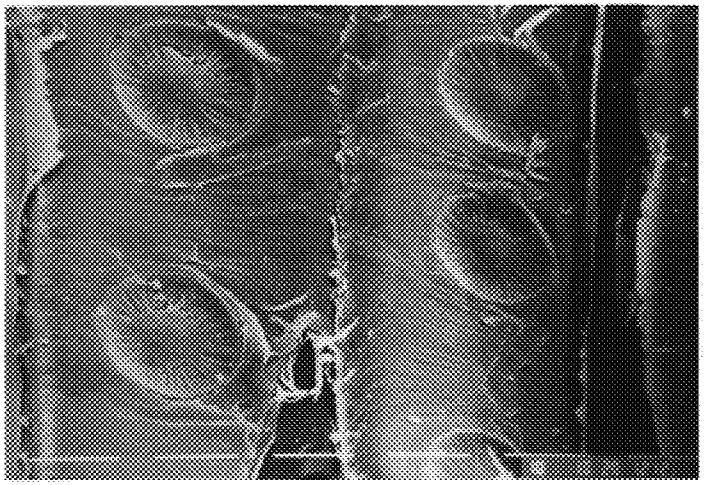
Figure 5D:
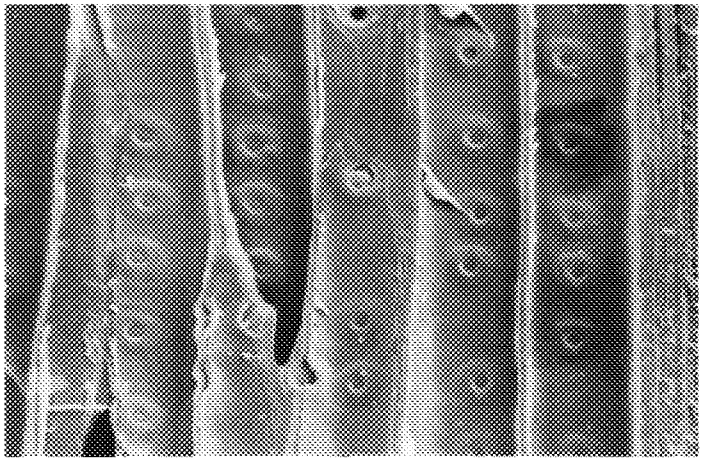
Figure 6A:
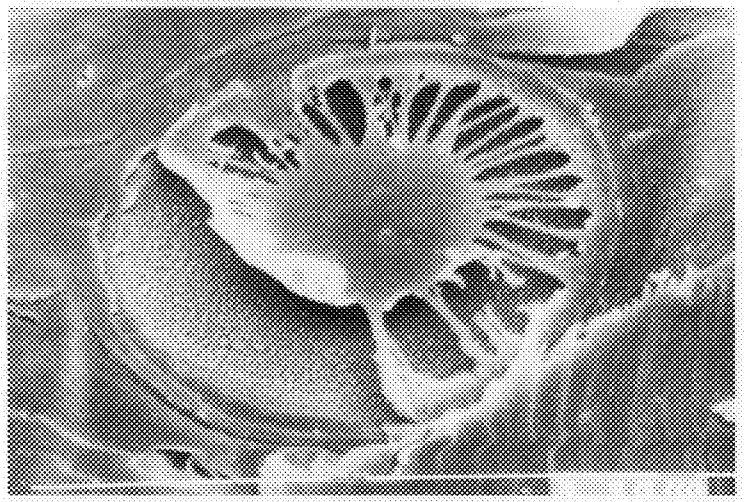
FIGS. 6(A)–(F) are similar electron micrographs showing tissue structure of wood treated in the above-mentioned form of the treatment chamber.
Figure 6B:
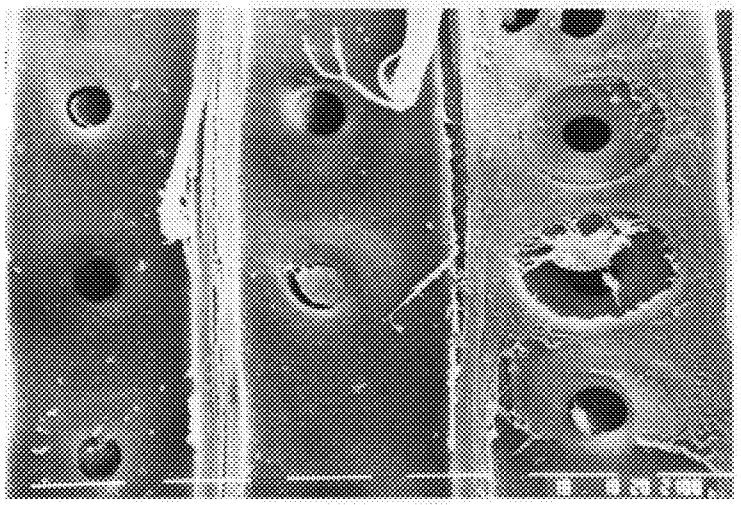
Figure 6C:
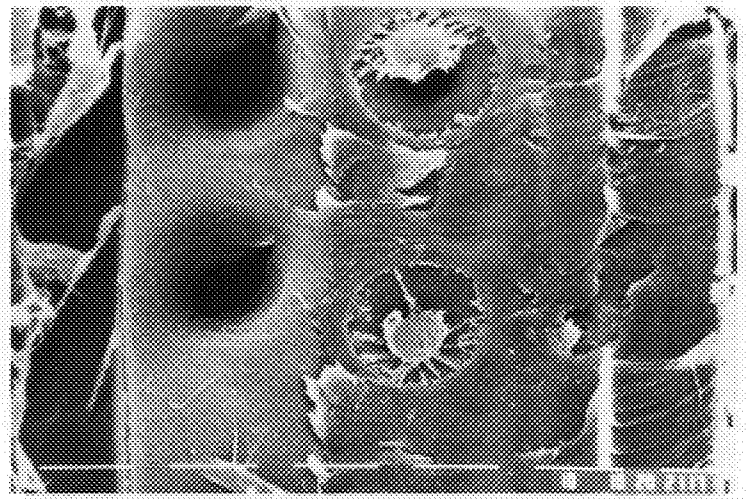
Figure 6D:
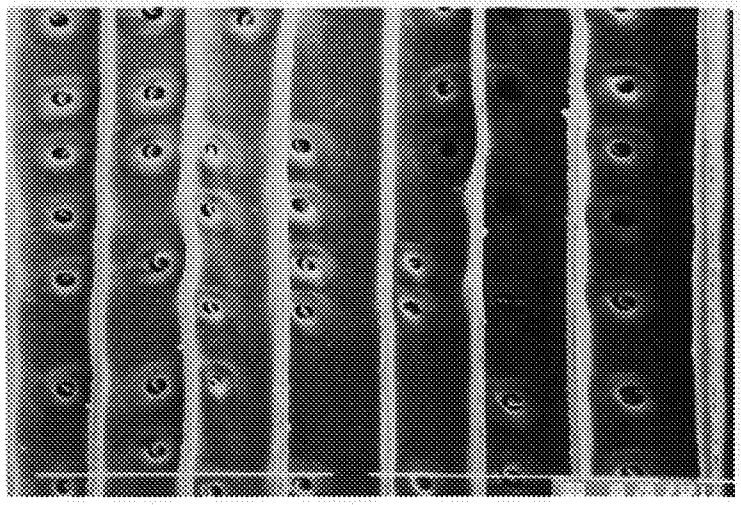
Figure 6E:
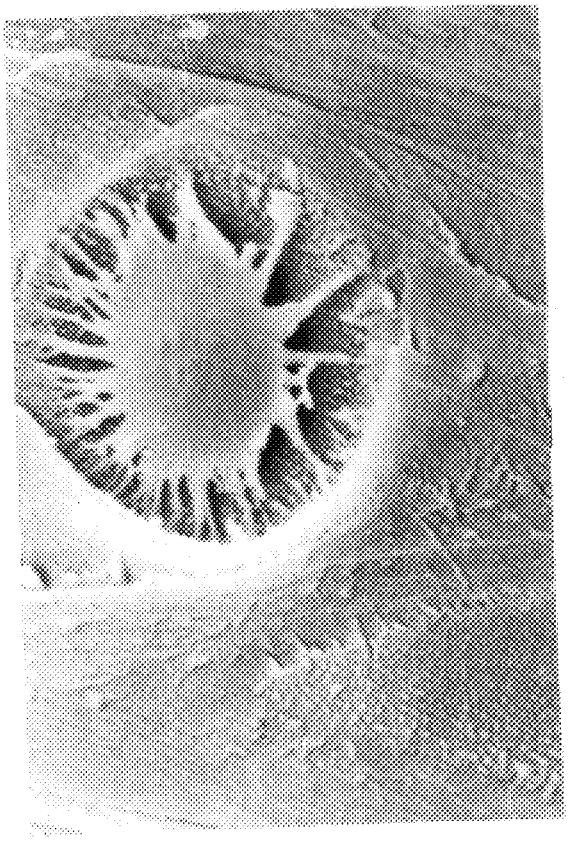
Figure 6F:
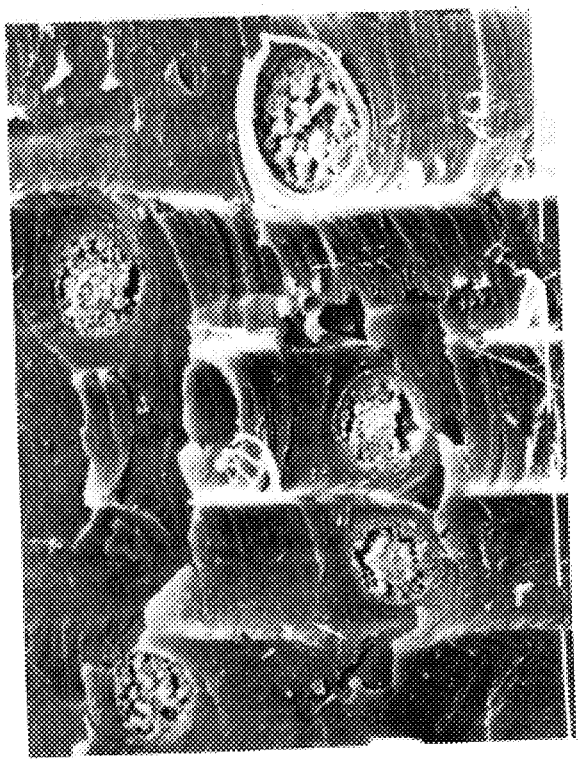

This also enables temperature decrease in the treatment chamber to be reduced. Accordingly, it is possible that long-lasting fuel such as log pieces are fed just before leaving a laboratory in the evening and leave the air intake slightly open so as to keep the fire alive, and at opening time on the Next morning, temperature in the treatment chamber is 60° C. or so, and the furnace is replenished, and the temperature soon raises to about 140° C. The daytime operation is simply checking a temperature sensor at every two hours. FIG. 4 (*a*) shows temperature conditions in the treatment chamber under such control operation.

As in FIG. 4(*b*), several tens sugi logs of 16 cm in diameter were stacked on the truck.

Temperatures in two logs of upper part logs placed at 1.5 m high and in two logs of lower part logs placed at 1.0 m high were measured, and temperature in the furnace was also measured by means of a temperature sensor provided at 1.0 m high in the treatment furnace. The results are shown in FIG. 4(*a*).

The measurement was performed over a period from Feb. 28 to Mar. 4, 1994. First, a stack of several tens sugi logs of 16 cm in diameter were placed in the furnace, and wood fuel was ignited about 8:30 am, Feb. 28th. Fuel was replenished three times at about 2-hour intervals before closing time in the evening. As shown in FIG. 4(*a*), the temperature in the furnace and the log temperatures rose by combustion of the wood fuel, and the temperature in the furnace rose up to about 140° C. in about 4 hours after the ignition. When flame intensity decreased due to consumption of the fuel 32 subsequent to the ignition, fuel 2 was replenished at 4 hours after the ignition.

The temperature in the furnace once lowered to about 120° C. However, the temperature in the furnace rose again as wood gas was vigorously generated by combustion of the replenished fuel 32, and was retained between 130° and 140° C. Thereafter, although the fuel 32 was consumed completely, fuel 32 was not replenished since the furnace temperature remained between 130°–140° C. At closing time in the evening, however, which did not permit continuation of monitoring of the furnace, fuel 32 was supplied to allow unattended operation. In view of prevention of complete consumption of fuel 32, the air intake I was narrowed to maintain combustion of the charged fuel 2 for a long time, thereby maintaining generation of wood gas. The furnace temperature somewhat rose by this replenishment of the fuel 32, but the furnace temperature fell gradually afterwards.

On arrival at the laboratory in the next morning (Mar. 1st), fuel 32 was resupplied to the furnace about 24 hours after the ignition. The supplied fuel 32 was ignited and the temperature in the furnace rose again to 120° C. About 28 hours after the ignition, the supplied fuel 32 was consumed and fuel 32 was anew supplied. At this time, the furnace temperature showed no substantial decrease and stayed between 130°–140° C. by combustion of the supplied fuel 32. About 39 hours after the ignition, supply of fuel 32 was stopped and the remaining fuel 32 on the grate 4 was allowed to be consumed.

At 48 hours after the ignition, the air intake was closed and the furnace was allowed to gradually cool over a period of about two days. When the temperatures in the logs became near ambient temperature, the logs were taken out of the furnace, cut into small pieces as required, and subjected to natural drying or dried in an artificial drying machine.

The temperatures in the logs under treatment (subject logs) are discussed with reference to FIG. 4. The temperature sensors embedded in the core of the logs under treatment (subject logs) showed that temperatures in two logs Cogs under treatment) placed at the upper part of the treatment chamber rose and reached about 100° C. in about 6 hours after the ignition, with wood gas filling the chamber.

On the other hand, temperature sensors embedded in two logs Cogs under treatment) placed at the lower part of the treatment chamber showed that temperatures thereafter continued to rise and reached about 60° C. about 12 hours after the ignition.

Subsequently, the temperatures of the logs placed at the upper part of the treatment chamber decreased as the temperature of the chamber decreased. However, the furnace was filled with owing to combustion of the fuel 32 supplied about 24 hours after the ignition, and the temperature in the furnace rose again, and in consequence thereof, the log temperatures rose up to 100° C. and then decreased gradually.

The temperatures of the logs (two) placed at the lower part of the treatment chamber afterward showed no substantial decrease and stayed nearly constant, and by the combustion of the fuel 32 supplied at 24 hours after the ignition, retained and reached the maximum of about 70° C. Tissue structure of the sugi specimen subjected to the above-described treatment and tissue structure of an untreated sugi specimen were examined by an electron microscope (magnification: 5,000–6,000X). For this purpose, longitudinal sections of sugi tracheids were prepared by a microtome. FIGS. 5 (1)–(4) are micrographs of the tissue structure of the untreated specimen, showing front views of pits in tracheid walls. As is apparent from FIGS. 5 (1) and (4), tori 1 are located at the center of pit-pair and no damage is observed in margos 2 in these micrographs. Such a structure implies that dehydration from cells is not easy and drying takes a long period of time.

On the other hand, in micrographs shown in FIGS. 6. (1) and (4), it is seen that the pits and tori are opened up by moisture gradient. It is apparent in FIG. 6 (1) that a torus 1 remains inside but a portion of a margo is severely damaged, thereby leading to complete loss of function to close a pit with the torus against moisture gradient caused. Thus, water in the cell readily escapes out of the cell through the broken pits. FIG. 6 (2) is a micrograph of pits in a longitudinal section of sugi tracheid. It is seen that after the above-described treatment, margos are completely broken and tori partially protrude from pits, thereby leading to complete loss of function of pit membranes.

It is also seen in FIGS. 6 (3) and (4) that pits, tori or margos in the treated specimen are completely or partially broken, thereby resulting in openings defined therebetween. In other word., in FIG. 6 (3), pits per se are deformed by the above-described treatment in contrast to normal pits with). remarkably circular shape, thereby preventing the water communication openings from being blocked with the tori.

It is found in FIG. 6 (4) that almost 100% of pit membranes are destroyed, for example, with tori partially protruding from pits, and as a result, water is permitted to move through the pits if moisture gradient is caused in drying of logs, thereby facilitating drying of logs.

Further, it is seen in FIGS. 6 (5) and (6) that tar adhered to pits as a result of the treatment.

Under such a condition, water in the cells which would otherwise be kept confined therein is permitted to readily escape out of the cell. It is generally said that sugi, in particular, heartwood of sugi tends to be difficult to dehydrate because more than 90% of its pits are aspirated pit-pairs. This does not apply to those subjected to the above-described treatment.

To make sure, proportions of aspirated pit-pairs are calculated with respect to the treated and untreated log specimens.

For the calculation, specimens of "sapwood", "white-line zone (intermediate wood)" and "heartwood" which were taken from portions of logs subjected to the above-described treatment at 1 cm and 40 cm from out end. For comparison, specimens of "sapwood", "white-line zone" and "heartwood" of the sa me wood but untreated are taken. Comparison was made therebetween with respect to numbers of broken pits.

Figure 7C:
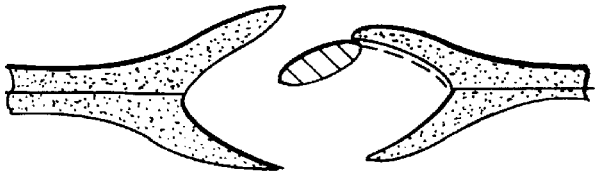
FIG. 7 is illustration showing conditions of broken pit membranes.
Figure 7B:
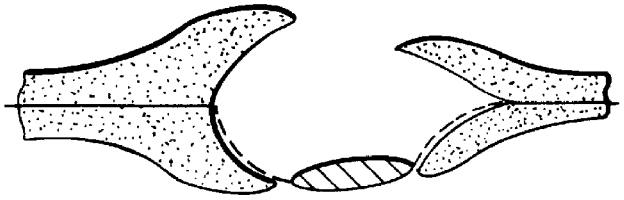
Figure 7A:
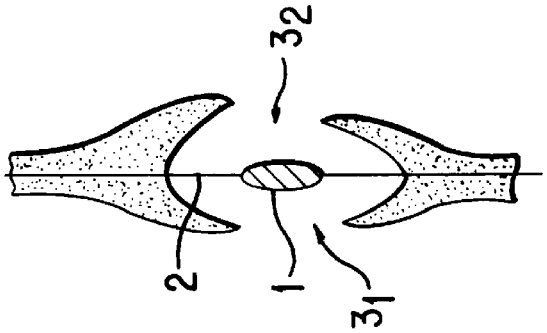

Damage states were classified as "aspirated pit state" (FIG. 7 )) and "partially broken pit state" (FIG. 7 (C)) in comparison with "normal state" (FIG. 7 (A)). Two hundred pits were examined with respect to each specimen for comparison. Table 1 shows the results.

TABLE 1

Proportions of aspirated pits and damaged pits (200 pits were examined)

| | | number (%) | | |
|---|---|---|---|---|
| | cl. | sapwood | w.-line zone | heartwood |
| treated wood | | | | |
| 1 cm from cut end | asp. pit | 44(22) | 66(33) | 69(35) |
| | dam. pit | 38(19) | 33(17) | 26(13) |
| | neut. pit | 118(59) | 101(51) | 105(53) |
| 40 cm from cut end | asp. pit | 58(29) | 46(23) | 78(39) |
| | dam. pit | 41(21) | 31(16) | 21(11) |
| | neut. pit | 101(51) | 123(62) | 101(51) |
| untreated random wood | asp. pit | 63(32) | 51(23) | 72(36) |
| | dam. pit | 13(7) | 14(7) | 13(7) |
| | neut. pit | 124(62) | 135(68) | 115(58) |

According to Table 1, it is seen that the percentage of damaged pits (shown in FIG. 7 (C) as described above) in the untreated wood is 7% for each of the sapwood, white-line zone (intermediate wood) and heartwood, and in contrast thereto, the percentages of damaged pits in the treated wood at 1 cm from cut end are increased to 19% for the sapwood, 17% for the intermediate wood, and 13% for the heartwood. In other words, The percentages are increased 1.9 to 2.7 times. This shows that when moisture gradient is caused between cells, the moisture gradient is uniformized by virtue of the damaged pits.

According to the calculation results for the locations at 40 cm from cut end, the percentages of damaged pits are as high as 21% for the sapwood, 16% for the intermediate wood, and 11% for the heartwood, which are 1.6 to 3.0 times as compared with those for the untreated wood. This shows that mobilities of water contained in cells are correspondingly increased by the ratios of 1.6 to 3.0.

To enhance reliability of examination, 500 pits were examined by electron microscopy for the treated wood at 1 cm from cut end. The results are as in Table 2.

TABLE 2

Proportions of aspirated pits, damaged pits, and neutral pits (500 pits were examined)

| | | number (%) | | |
|---|---|---|---|---|
| | cl. | sapwood | w.-line zone | heartwood |
| treated wood | | | | |
| 1 cm from cut end | asp. pit | 150(30) | 220(44) | 222(44) |
| | dam. pit | 257(51) | 117(23) | 116(33) |
| | neut. pit | 93(19) | 163(33) | 162(33) |
| untreated random wood | asp. pit | 269(54) | 271(54) | 257(52) |
| | dam. pit | 61(12) | 28(6) | 33(6) |
| | neut. pit | 170(34) | 201(40) | 210(42) |

As is apparent from Table 2 making a comparison between the treated wood and the untreated wood, the percentages of damaged pits in the untreated wood are 12% for the sapwood, 6% for the intermediate wood, and 6% for the heartwood, i.e., the damaged pits are present at an average proportion of 8%, and in contrast thereto, the percentages of damaged pits in the treated wood at 1 cm from cut end are 51% for the sapwood, 23% for the intermediate wood, and 23% for the heartwood, giving an average presence ratio of 33%. The ratio of presence is as high as more than 4.1 times that of the untreated wood.

Accordingly, correspondingly to the increase in the percentage of damaged pits, removal of contained water is accelerated (drying is accelerated) if moisture gradient is caused between cells, thus facilitating drying of wood after the treatment.

From this feature, with respect to the wood having the damaged pits, water initially contained in cells is emitted therefrom in several days after the treatment to facilitate drying.

By virtue of this, dried state can be attained in a short period of time due to improved water transfer through vessels and tracheids, even under natural drying conditions. Further, due to improved water transfer through vessels and tracheids, the treated wood undergoes no substantial "crack" or "warpage" when subjected to artificial drying which is rapid drying, as compared with an untreated wood.

In this example, the treatment is effected by means of the wood gas containing multiplied far-infrared radiation. However, any method may be employed so long as it is capable of efficiently raising a wood temperature in such a manner that heat is readily transferred even into a wood core.

In this example, the treated wood was the logs placed in the upper part of the furnace at 1.5 m high which are referred to as upper logs. The temperature in the logs rapidly reached 100° C. after the ignition. From the results of the examination by electron microscopy (x5,000–6,000), difference between the tissues of the treated and untreated logs is clearly observed. In other words, as is apparent from FIGS. 5 (1) and (4), the micrographs of the untreated logs show tori located at the center of pit-pairs and no damage in margos 2.

It is easily recognized that such a condition results in poor release of water in cells and drying takes a markedly long period of time.

Industrial Applicability

According to the present invention, pits or pit membranes present between cells of wood are completely or partially broken to form gaps in the pit membranes, thereby attaining excellent effect that water contained in the cells constituting the wood is readily removed in subsequent wood drying process to facilitate wood drying.

In particular, removal of water contained in cells constituting wood can be effected rapidly and evenly in sapwood and heartwood, and as a result, dried wood undergoes no substantial crack, crook, torsion or warpage. This enables wood having improved quality to be provided.

Further, since pits or pit membranes present between cells of wood are broken to form gaps in the pit membranes, the wood can readily be impregnated with a preservative, mothproofing agent, flame retardant or the like through the gaps. Consequently, even intermediate wood of sugi or Japanese larch can readily be used as a constructional material. Moreover, wood whose pit membranes have gaps is known to exhibit enhanced acoustic effect. Accordingly, wood having its pits or pit membranes present between cells thereof broken to form gaps in the pit membranes can be utilized as a material for musical instruments. Even a low quality wood which has not been able to be used as a material for musical instruments can be given a way to utility as a material for musical instruments.

I claim:

1. A pit membrane-broken wood having broken pit membranes comprising broken pits between cells constituting the wood obtained by either (1) allowing subject wood to stand in wood gas obtained by combustion of wood fuel for a predetermined period of time or (2) irradiating subject wood with far-infrared radiation to raise the temperature in the wood by penetration thereof thereby breaking the pits.

2. The pit membrane-broken wood according to claim 1, wherein the pits are present as pit-pairs between cells constituting the wood, and the broken pit membranes ale partially or completely broken by deformation or crack in one or the other pit of said pit-pairs.

3. The pit membrane-broken wood according to claim 2, wherein the broken pit membranes have gaps which prevent the pits from being closed completely with tori present between the pits.

4. The pit membrane-broken wood according to claim 3, wherein margos of the pit membranes present in the pit-pairs are partially or completely broken.

5. The pit membrane-broken wood according to claim 4, wherein the broken pit membranes have gaps which prevent the pits from being closed completely due to outward protrusion of tori of the pit membranes present in the pit-pairs from the pits which are broken by the tori.

6. The pit membrane-broken wood according to claim 1, wherein the Site are present as pit-pairs between cells constituting the wood, and the broken pit membranes are broken due to adhesion of tar contained in said wood gas onto peripheral portions of one or both pits of said pit-pairs.

7. The pit membrane-broken wood according to claim 1, wherein the pits are present as pit-pairs between cells constituting the wood, and the broken pit membranes are broken due to adhesion of resinous components contained in the wood onto peripheral portions of one or both pits of said pit-pairs.

8. The pit membrane-broken wood according to claim 1, wherein the pits are present as pit-pairs between cells constituting the wood, and the broken pit membranes are broken due to adhesion of tar contained in said wood gas onto margos inside said pit-pairs.

9. The pit membrane-broken wood according to claim 1, wherein the pits are present as pit-pairs between cells constituting the wood, and the broken pit membranes are broken due to adhesion of resinous components contained in the wood onto margos inside said pit-pairs.

10. The pit membrane-broken wood according to claim 1, wherein the pits are present as pit-pairs between cells constituting the wood, and the broken pit membranes are pit membranes whose pits between cells are prevented from being sealed with tori due to adhesion of tar contained in said wood gas onto the tori.

11. The pit membrane-broken wood according to claim 1, wherein the pits are present as pit-pairs between cells constituting the wood, and the broken pit membranes are pit membranes whose pits between cells are prevented from being sealed with the tori due to adhesion of resinous components contained in the wood onto the tori.

12. A method for breaking pits between cells constituting wood, the method comprising:

allowing subject wood containing pit membranes, each of said pit membranes containing a torus, a margo, and pits, to stand in wood gas obtained by combustion of wood fuel for a predetermined period of time thereby breaking the pits.

13. The method according to claim 12, wherein the subject wood is allowed to stand in a wood gas and the temperature of the subject wood is raised to about 100° C.

14. The method according to claim 12, wherein the temperature of the subject wood is raised to about 100° C. in about six hours after ignition of said wood fuel.

15. A method for preparing pit membrane-broken wood, the method comprising:

irradiating subject wood containing pit membranes, each of said pit membranes containing a torus, a margo, and pits, with far-infrared radiation to raise temperature in the wood by penetration thereof, thereby breaking the pits.

16. The method according to claim 15, wherein the far-infrared radiation is generated by the combustion of said wood fuel.

17. The method according to claim 13, wherein far-infrared radiation is obtained by providing a chamber filled with a far-infrared multiplying ceramic material above flames of said burning wood fuel for multiplying the far-infrared radiation and promoting breakage of the pit membranes, and heating said ceramic material to glow red in order to generate far-infrared radiation.

18. An apparatus for preparing pit membrane-broken wood comprising:

a combustion chamber having an air intake and a combustion grate for combustion of a wood fuel placed thereon, a temperature maintaining chamber, which is in communication with the combustion chamber via airholes and filled with a far-infrared multiplying ceramic material for efficiently generating and multiplying far-infrared radiation, for promoting breakage of the pit membranes, and for maintaining the temperature of the furnace, and a heating and treating chamber having a ventilating fan for introducing a wood gas and controlling the temperature in the treating chamber, glass wall heat insulator for preventing heat in the treating chamber from escaping, and ceramic boards for efficiently converting the heat into far infrared radiation in walls and floor thereof.

19. An apparatus according to claim 18, wherein said ceramic material comprises lava rock.

* * * * *